US006520337B2

(12) United States Patent
Smith

(10) Patent No.: US 6,520,337 B2
(45) **Date of Patent: *Feb. 18, 2003**

(54) UNITARY PRODUCT CUSHIONING STRUCTURE

(76) Inventor: Forrest Smith, 1053 Avenue Road, Toronto (CA), M5N 1X5

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/490,848

(22) Filed: Jan. 24, 2000

(65) Prior Publication Data

US 2002/0023857 A1 Feb. 28, 2002

(51) Int. Cl.[7] ..... B65D 81/02

(52) U.S. Cl. ..... 206/592; 206/470; 206/557; 206/586

(58) Field of Search ..... 206/585, 586, 206/591, 592, 557, 521, 564, 470, 471; 220/4.22, 4.23

(56) References Cited

U.S. PATENT DOCUMENTS

| | | | | | |
|---|---|---|---|---|---|
| 435,023 | A | * | 8/1890 | Robinson | 206/521 |
| 2,874,826 | A | | 2/1959 | Matthews et al. | |
| 3,294,223 | A | | 12/1966 | Goban | |
| 3,910,411 | A | * | 10/1975 | Deeren | 206/521 |
| 4,512,474 | A | * | 4/1985 | Harding | 206/461 |
| 4,558,782 | A | * | 12/1985 | Iverson et al. | 206/387 |
| D283,489 | S | * | 4/1986 | Stevens | 206/460 |
| 4,905,835 | A | | 3/1990 | Pivert et al. | |
| 5,226,543 | A | | 7/1993 | Foos et al. | |
| 5,385,232 | A | | 1/1995 | Foos et al. | |
| 5,405,000 | A | * | 4/1995 | Hagedon et al. | 206/216 |
| 5,515,976 | A | | 5/1996 | Moren et al. | |
| 5,626,229 | A | | 5/1997 | Dickie et al. | |
| 5,628,402 | A | | 5/1997 | Dickie et al. | |
| 5,799,796 | A | | 9/1998 | Azelton et al. | |
| D401,765 | S | * | 12/1998 | Soutullo | D4/199 |
| 6,010,007 | A | * | 1/2000 | Moren et al. | 206/587 |
| 6,109,444 | A | * | 8/2000 | Bagwell et al. | 206/589 |
| 6,123,200 | A | * | 9/2000 | Stephens et al. | 206/592 |

FOREIGN PATENT DOCUMENTS

EP 0 573 181 A2 8/1993

* cited by examiner

*Primary Examiner*—Shian Luong
(74) *Attorney, Agent, or Firm*—Marks & Clerk

(57) ABSTRACT

A unitary product cushioning structure for supporting a shock sensitive product in an outer packaging container is formed of moldable resilient plastics material. It has an outer container contacting wall at each side which is intended to contact an outer packaging container, and a flexible shock absorbing spring section at each such side. A product supporting region is bounded by outer product supporting region defining walls, inner product contacting walls, an upper ridge between them, and a product supporting platform. Shock absorption support for a shock sensitive product is provided in at least two of three mutually perpendicular directions; most embodiments, including end pieces, end caps, trays and covers, and corner pieces, provide shock absorption protection in three mutually perpendicular directions. The structure is usually thermoformed, but may be otherwise molded from a suitable resilient and moldable plastics material.

23 Claims, 7 Drawing Sheets

UNITARY PRODUCT CUSHIONING STRUCTURE

FIELD OF THE INVENTION

This invention relates to product cushioning devices for use in packaging shock sensitive products. In particular, the invention relates to re-usable or recyclable product cushioning devices which are made from plastics material, and which may have several different embodiments including corner pieces, edge pieces, and end caps. Each of the embodiments of the present invention comprises a unitary structure which may be molded from a plastics material using a variety of molding techniques.

BACKGROUND OF THE INVENTION

The use of product cushioning devices for shock sensitive products has been known for many years. Typically, cushioning for shock sensitive devices comprises a number of different approaches, each of which may have its own particular advantages and/or disadvantages.

For example, it has been known for many years to wrap shock sensitive or delicate devices or merchandise in tissue paper, and to cushion the products with loosely balled tissue paper. Another use of paper has been shredded paper, or excelsior. A more elegant approach has been to use bubble-pack, which comprises a sheet material having a plurality of contained bubbles of air formed therein. Another approach which has been used for many years has been the use of a plurality of discrete molded foamed polystyrene pellets, sometimes referred to as "peanuts" in the industry, to fill around a product in a container.

As the requirement for better packaging and cushioning became more demanding, for example with the introduction to the market of complicated and expensive electronics devices such as computer monitors, and more particularly notebook computers, printed circuit boards, and the like, the requirement arose for more sophisticated and better shock absorbing cushioning devices. Standards were developed for acceptance of cushioning devices, including drop tests and the like, to determine if such devices would protect the shock sensitive product from shock acceleration greater than the product's fragility level—typically, from 20 g's to 100 g's.

This has given rise to the use of such products as honeycomb cardboard, and particularly foamed polystyrene, foamed polyurethane, foamed polypropylene, or foamed polyethylene. Flexible foam devices are well known for use as corner pieces or edge pieces. Likewise, foamed polystyrene products—which are more rigid—are also well known for use as corner pieces or end caps; and very often, they are product specific in that they are particularly molded having a specific configuration for use with a particular product.

In general, however, flexible foam cushioning devices, and foamed polystyrene cushioning devices, are not recyclable. There are several reasons for that condition: The first is that flexible foam cushioning devices, and polystyrene cushioning devices, tend to be quite bulky, and are usually discarded with the packaging container in which the product has been shipped. There are very few specific recycling depots that are set up for either flexible foam or especially polystyrene cushioning devices; and, in any event, foamed polystyrene and foamed polyurethane cannot generally be recycled. Its re-usability may be provided for, particularly as general corner pieces, if they remain intact, or as product specific end caps; but, unless such foamed polystyrene cushioning devices are being used in a closed shipping system, they will not be recovered for re-use. Moreover, foamed polystyrene cushioning devices tend to be very frangible, and do not maintain their integrity very well once they have been used and removed from the packaging container in which they are shipped.

More elegant cushioning devices have more recently entered the market, comprising different types of blow-molded or other plastics shell products, most of which are closed structures which are filled with air or other gas. Some such structures are inflatable, some are closed, and some may be open to the atmosphere but are formed of a relatively rigid material. All such products are generally formed from high density polyethylene, which may be recycled because it is easily chopped up and made into further products, or such products may be re-usable if they are employed in a closed delivery and recovery system. Low density polyethylene may also be found in products such as those described immediately above, although its use is quite limited at the present time.

As will be discussed in greater detail hereafter, the present invention also provides a recyclable and re-usable product cushioning device which has a unitary construction and is formed of a plastics material. As will be noted, the present invention provides such a product cushioning device as a tray or cover, a clamshell, an end cap, a corner piece, or an end piece. However, the present invention does not present a closed structure, such as a number of prior art devices which are discussed hereafter; rather, the present invention provides a product cushioning device which is such that it may be stackable. This feature means that product cushioning devices in keeping with the present invention may be stored in much smaller storage volumes than previously may have been required at the factory or shipping warehouse where the products in association with which the product cushioning devices of the present invention will be used. Moreover, when the products have been delivered to the end user, the product cushioning devices may again be stacked for re-usability, or even roughly cut or chopped up for recycling of the material.

All embodiments of the present invention, as described in greater detail hereafter, provide cushioning and shock force absorption and/or transmission, and thus shock absorbing protection, for whatever product they are being used with, in at least two of three mutually perpendicular axes for which shock absorption protection is required—vertical, front-to-back, and side-to-side. In most embodiments of the present invention, apart from edge pieces, shock absorbing protection for a product is provided in all three mutually perpendicular directions.

DESCRIPTION OF THE PRIOR ART

U.S. Pat. No. 2,874,826 issued to MATTHEWS et al. is directed to a shock and vibration isolation device which, however, is not intended for being incorporated in a rectilinear container. Rather, this device is a resilient and inflatable jacket comprising a plurality of chambers, made of a rubberized fabric which is adapted to hold a gas under pressure, and which will be wrapped around a shock sensitive device such as a guided missile so as to provide a shock and vibration isolation container therefor.

GOBAN U.S. Pat. No. 3,294,223 teaches a molded plastic corner piece having the configuration of a triangular polyhedron which is either rounded or flattened at its apex. The purpose of the corner support is to entrap air between the molded plastic corner piece and the corner of the carton into which it is placed.

U.S. Pat. No. 4,905,835 issued to PIVERT et al. teaches inflatable cushion packaging wherein a plurality of chambers are inflated so as to provide cushioning which will absorb shock and thereby protect a shock sensitive product located in the centre of the container. The amount to which the balloon-like chambers may be inflated, and therefore their hardness, may be controlled.

FOOS et al. U.S. Pat. No. 5,226,543 teaches a packaging structure which includes both a platform portion and a sidewall portion, wherein the sidewall portion forms an enclosure around the platform portion. Essentially, this product is an end cap or platform. The sidewall has both inner and outer walls which are joined by a bridge section, and the inboard wall is relatively shorter than the outboard wall such that the platform portion holds the fragile article at a specific distance above the lower edge of the outboard wall. Shock absorbing formations—typically, notches—are formed in the bridge portion of the sidewall. These notches have a degree of elasticity such that, when the packaging structure is loaded and then unloaded, or shocked and then unloaded, the notch will return to its original shape and can absorb multiple loads without deteriorating. However, in order for the elasticity to exist, a material with a high degree of stiffness must be used—typically, that material is high density polyethylene. The patent requires that the inboard wall is shorter than the outboard wall.

Another patent issued to Foos et al. is U.S. Pat. No. 5,385,232. This patent also teaches a sidewall structure which forms an enclosure around a platform portion. However, the teachings of this patent also address the issue of light shock loads that may not deform or compress the shock load formations—the notches that are discussed in the previous Foos et al. patent. Here, the concept of openings which provide for collapsibility and allow for the release of compressed air beneath the package when the package is subject to shock loading, is introduced. These collapsible openings may be located in the platform at various locations, and may have a variety of shapes. Still, like the other Foos et al. patent, the teaching is directed to the use of inboard and outboard walls as well as the use of the shock formations (the notches) that have an elastic characteristic.

MOREN et al. U.S. Pat. No. 5,515,976 teaches a structure which has side flanges that are adapted to contact all sides of an end portion of a fragile article, and is thus configured as an end cap. There are a number of protrusions disposed throughout the sidewalls to support the article. There is also a notch provided in the side wall as a means to absorb shock loads. The end cap of this patent is also provided with at least one crush button for absorbing shocks applied along the longitudinal length of the fragile article.

Two related patents issued to DICKIE et al., U.S. Pat. No. 5,626,229 and U.S. Pat. No. 5,628,402 each are directed to a gas-containing product supporting structure which takes the form of a plastic bladder shaped on one side to provide a cavity having internal dimensions which match the external dimensions of the product to be protected, and shaped on its other side to have external dimensions which match the internal dimensions of the shipping container into which it is placed. The product is semi-rigid and self-supporting, monolithic, and gas-containing and may take the form of a corner piece or an end piece or tray for the product to be protected. The semi-rigid and self-supporting gas-containing bladder will retain its shape irrespective of whether it is sealed or open to the ambient surroundings; and will generally comprise a plurality of chambers in the interior of the product supporting structure with gas communication between the chambers so that the gas that is within the structure may flow from one chamber to another during shock loading circumstances of operation.

AZELTON et al. U.S. Pat. No. 5,799,796 teaches a unitary spring system end cap packaging unit. Here, the structure includes an inner wall, an outer wall, and a spring system disposed between them. The spring system includes at least one flexible harmonic bellows which forms a flexible ridge that has an arcuate shape along the length of the sidewall structure. A cushioning space exists between the edge of the inner sidewall and the edge of the outer sidewall. Dimples may be provided on the inner surfaces of the sidewall to allow a friction fit of the end cap to the product over which it will be placed. The arcuate harmonic bellows form flexible ridges that are elastic in nature; and each bellows of the spring system operates independently when a shock load is applied.

A co-pending U.S. patent application in the name of the inventor herein, Ser. No. 09/286,843, filed Apr. 6, 1999, teaches a cushioning device which has a molded post as an integral part thereof. The post is designed to extend into an intersecting corner between two perpendicular packaging container sides, or into the corner formed by three mutually perpendicular packaging container sides. A product supporting surface is spaced away from a related packaging container side by a container contacting flange and a curved ridge. In a shock loading situation, the curved ridge will at least temporarily be further curved away from the post, and the product supporting surface will at least temporarily move closer to it's related packaging container side.

SUMMARY OF THE INVENTION

In its broadest sense, and as a common feature of any of the embodiments of the present invention—corner piece, edge piece, or end cap—the present invention provides a product cushioning device which, in all events, is intended for supporting a shock sensitive product in an outer packaging container. In its broadest sense, the present invention is applicable for use in any container which has at least parallel and planar top and bottom surfaces and at least three planar side surfaces, each of which is perpendicular to the planar top and bottom surfaces. As will be discussed hereafter, there are several embodiments of the present invention, which may be configured as an end cap, a corner piece, a tray or cover, an end piece, an edge supporting piece, or in the form of a clamshell.

Any unitary product cushioning structure in keeping with the present invention is adapted to provide shock absorption protection for a shock sensitive product during shock loading conditions. Those shock loading conditions may be in any one, two, or three of three mutually perpendicular directions—usually considered to be defined by X, Y, and Z axes. The X-axis is considered to be a side-to-side axis with respect to the cushioning structure, or indeed with respect to the product. The Y-axis is a front-to-back axis; and the Z-axis is a vertical axis. However, those axes, and their orientation with respect to front, back, side, or verticality, are purely arbitrary. Obviously, a product, when packaged, can be loaded, stacked, or dropped, in any orientation. Thus, it will be recognized in the following discussion, and in the appended claims, that discussion of specific axes is, indeed, arbitrary. Indeed, for the most part—at least in the appended claims—there is no particular reference or relevance to discussions of orientation, except as a matter of convenience.

In any event, and in its broadest sense, the unitary product cushioning device of the present invention is formed of a moldable resilient plastics material:

At least one outer container contacting wall is found in any unitary product cushioning structure in keeping with the present invention, and it provides contact with an outer packaging container in at least a first one of the three mutually perpendicular directions to be considered. There is also a flexible shock absorbing spring transition section which is formed inwardly of the at least one outer container contacting wall.

The unitary product cushioning structure also includes a product supporting region which has at least one outer product supporting region defining wall, at least one inner product contacting wall, at least one upper ridge between the outer product supporting region defining wall and the inner product contacting wall, and a product supporting platform extending inwardly from the inner product contacting wall.

The inner product contacting wall is adapted to provide shock absorption support for a product during shock loading conditions in at least one of the three mutually perpendicular directions. Moreover, the product supporting platform is adapted to provide shock absorption support for a product during shock loading conditions in a second direction, which second direction is perpendicular to at least the first one of the three mutually perpendicular directions, as noted immediately above.

The configuration of the flexible shock absorbing spring transition section is such that it is curved. The direction of the curve is outwardly and away from the product supporting region defining wall which is adjacent each respective flexible shock absorbing spring transition section.

As described above, where the unitary product cushioning structure of the present invention comprises a single outer container contacting wall, and a single outer product supporting region defining wall, together with a single inner product contacting wall and a single ridge formed between them, the unitary product cushioning structure is configured as an edge supporting piece.

A fairly typical configuration of the unitary product cushioning structure of the present invention is as a corner piece. When thus configured, there are two outer containing contacting walls arranged perpendicular to each other, and the two outer container contacting walls are adapted to contact two walls of an outer packaging container which are perpendicular to one another. Thus, the cushioning structure will provide shock absorption protection for a shock sensitive product during shock loading conditions in three mutually perpendicular directions.

Another embodiment of unitary product cushioning structure of the present invention which will provide shock absorption protection for a shock sensitive product during shock loading conditions, in three mutually perpendicular directions, is that which can be considered to be an end cap, a tray or cover; or, alternatively, either half of a clamshell. In such configuration, there are four outer container contacting walls arranged in two opposed pairs thereof, so that the opposed pairs of outer container contacting walls are substantially parallel to one another. The two pairs of outer container contacting walls are adapted to contact four walls of an outer packaging container arranged in the form of a rectangle.

Yet another configuration is that of an end cap, having three outer container contacting walls arranged with one opposed pair of those walls being substantially parallel to one another, and with the third outer container contacting wall being disposed between the opposed pair of walls, and perpendicular thereto. The configuration is such that the three outer container contacting walls are adapted to contact the three walls of an outer packaging container, where two of the three walls of the outer packaging container are substantially parallel to one another and the third wall is disposed between the first two walls and is perpendicular thereto. Once again, this structure provides shock absorption protection for a shock sensitive product during shock loading conditions, in three mutually perpendicular directions.

In some embodiments of the present invention, the outer container contacting wall or walls may be downwardly directed; while, in other embodiments of the present invention, the outer container contacting wall or walls are upwardly directed.

In a particular embodiment of the present invention, where the outer container contacting wall or walls are downwardly directed, such a wall or walls has a bottom edge which provides an outer packaging container contacting surface for the cushioning structure to contact a surface of an outer packaging container in a direction aligned with the at least one outer container contacting wall. Such contact is perpendicular to the at least first one of the three mutually perpendicular directions in which contact is made by the at least one outer container contacting wall.

In another embodiment of the invention, where the outer container contacting wall or walls are upwardly directed, an outer packaging container contacting surface is provided for the cushioning structure to contact a surface of an outer packaging container in a direction aligned with the at least one container contacting wall by at least a portion of the outer surface of the flexible shock absorbing spring transition section.

Indeed, as a general embodiment, but not exclusively as noted above, the outer packaging container contacting surface may be provided so as to contact a surface of an outer packaging container in a direction perpendicular to the at least first one of the three mutually perpendicular directions by which the at least one outer container contacting wall has contacted the outer container, by at least a portion of the outer surface of the flexible shock absorbing spring transition section.

A clamshell unitary product cushioning structure in keeping with the present invention may be provided by having two portions which each have two opposed pairs of outer container contacting walls, each associated with the respective at least one flexible shock absorbing spring transition section, and each portion having a product supporting region. In this embodiment, the two portions of the cushioning structure are bound together by a living hinge formed therebetween.

Some embodiments of the present invention might comprise at least two flexible shock absorbing spring transition sections between the at least one outer container contacting wall and the at least one outer product supporting region defining wall. In this case, the at least one outer container contacting wall is discontinuous between each of the at least two flexible shock absorbing spring transition sections.

In other embodiments of the present invention, there may be at least one flexible shock absorbing spring transition section formed in at least two portions, each separated one from the other by a stiffening rib extending between the respective outer container contacting wall and the respective outer product supporting region defining wall.

In any corner piece embodiment of the present invention, a further embodiment may provide that a portion of each of the outer product supporting region defining walls, a portion of each of the inner product contacting walls, and a portion of each of the upper ridges may be chamfered, in the region where the upper regions intersect to define a corner of the product supporting region of the unitary product cushioning structure. Where the chamfered region is located, a web is formed between the respective outer product supporting region defining walls and the inner product contacting walls.

An end piece configuration of the present invention may also have two chamfered corners, where the three outer product supporting region defining walls, the inner product contacting walls, and the three upper ridges, define two respective corners of the end piece configuration. Here, once again, a portion of each of the outer product supporting region defining walls, a portion of the inner product contacting walls, and a portion of the upper ridges, in each region where the respective pairs of upper ridges intersect, is chamfered, and a web is formed between the respective outer product supporting region defining walls and inner product contacting walls.

Still further, a rectangular configuration of the unitary product cushioning structure of the present invention, such as an end cap or tray, for example, may have a portion of each of the outer product supporting region defining walls, of each of the inner product contacting walls, and each of the upper ridges, in each region where the respective pairs of upper ridges intersect, to be chamfered. Once again, a web is formed in each of the chamfered regions between the respective outer product supporting region defining walls and the inner product contacting walls.

Typically, the length of the inner product contacting wall is in the range of 10% to 80% of the length of the outer product supporting region defining wall. More typically, the length of the inner product contacting wall is generally less than 60% of the length of the outer product supporting region defining wall.

Moreover, the inner product contacting wall may have a convoluted configuration, with a plurality of ridges which extend between the product supporting platform and the upper ridge. This is to accommodate a variety of otherwise more or less similar products, as discussed hereafter.

In any configuration of the present invention, the product supporting platform and the inner product contacting walls may be configured to receive a product—or a portion of a product—which has a predetermined configuration.

In general, the unitary product cushioning structures of the present invention are stackable. This is achieved by molding the cushioning structures in such a manner that each outer container contacting wall, each outer product supporting region defining wall, and each inner product contacting wall, is sloped.

In general, the unitary product cushioning structures of the present invention are thermoformed from sheet plastics material. The compression strength of the molded unitary structure, and thereby its ability to withstand shock forces, will vary as a function of the thickness of the thermoformable sheet plastics material from which the molded unitary product cushioning structure has been thermoformed.

Another manner by which the ability of the unitary product cushioning structure of the present invention may be configured to withstand shock forces is by varying the width and depth of each flexible shock absorbing spring transition section formed in the molded unitary product cushioning structure.

Still further, the outer product supporting region defining wall may be formed in a stepped configuration, so as to have a series of discrete steps.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

Figure 1:
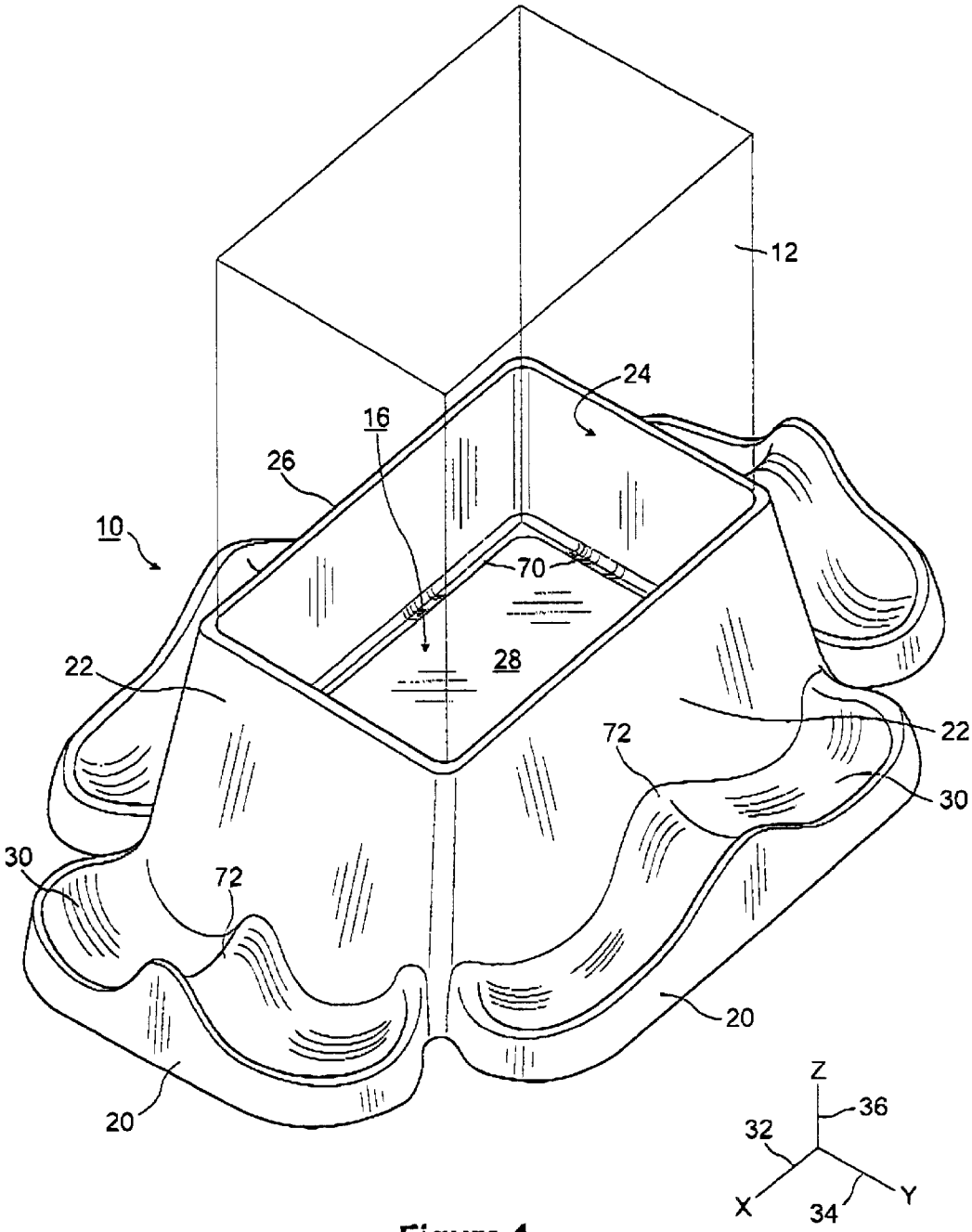
FIG. 1 is a perspective view of a first embodiment of a unitary product cushioning structure in keeping with the present invention.
Figure 9:
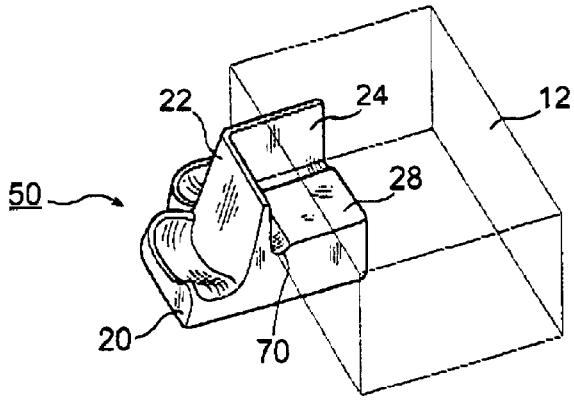
FIG. 9 is a further perspective view of the embodiment of FIG. 7.
Figure 10:
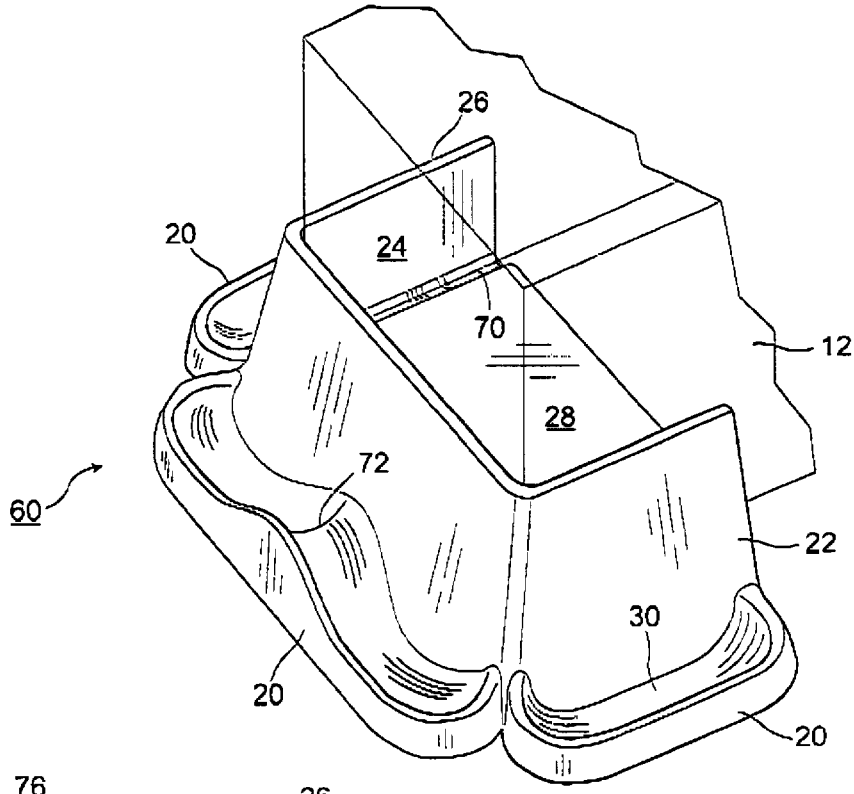
FIG. 10 is a perspective view of an end piece configuration of a unitary product cushioning structure of the present invention.

In each of FIGS. 1, 9, and 10, a general outline of a product being supported and protected by the respective unitary product cushioning structure configuration, is shown.

DETAILED DESCRIPTION OF THE PREFERRED EMBODIMENTS

Turning first to FIG. 1, there is first some discussion to introduce some of the basic concepts and premises surrounding the design and function of unitary product cushioning structures in keeping with the present invention, and to introduce the terminology which is particularly employed herein.

A typical unitary product cushioning structure in keeping with the present invention is shown at 10 in FIG. 1. It is intended for use with a product, the general outline of which is shown at 12. The nature of the product 12 is immaterial to the operation and function of the present invention, except that it will be noted that the product is a shock sensitive product. Typically, such products are electronic products of all sorts, such as laptop computers, computer drives, tape drives, circuit boards, etc. Other products might be assembled computer cases and other assembled electronic products of all sorts, and other manufactured fragile products made of glass or ceramics, for example.

The principal components of any unitary product cushioning structure in keeping with the present invention, comprises the following: Each unitary product cushioning structure in keeping with the present invention will comprise at least one outer container contacting wall 20. In the outer region of the unitary product cushioning structure, there is a product supporting region 16. It is bounded at its periphery by outer product supporting region defining walls 22, inner product contacting walls 24, and upper ridges 26 formed between the outer product supporting region defining walls and the inner product contacting walls 24. The lower portion (as shown in FIG. 1) of the product supporting region 16 terminates in a product supporting platform 28.

Between each outer container contacting wall 20 and the respective outer product supporting region defining wall, there is a flexible shock absorbing spring transition section or sections 30. Typically, each flexible shock absorbing spring transition section 30 has a curved configuration, with the direction of the curve being outwardly and away from the respective outer product supporting region defining wall 22.

For ease of discussion, three mutually perpendicular axes 32, 34, and 36 are shown in FIG. 1, representing "X"-axis, "Y"-axis, and "Z"-axis, respectively. Typically, the "Z"-axis is vertical; however, if any unitary product cushioning structure in keeping with the present invention, particularly a configuration such as that shown in FIG. 1, is used as an end cap, for example, then actual verticality might be along either the "X"-axis or the "Y"-axis, depending on the orientation in which the outer packaging container in which the shock sensitive product and its respective unitary product cushioning structure, have been placed.

Figure 2:
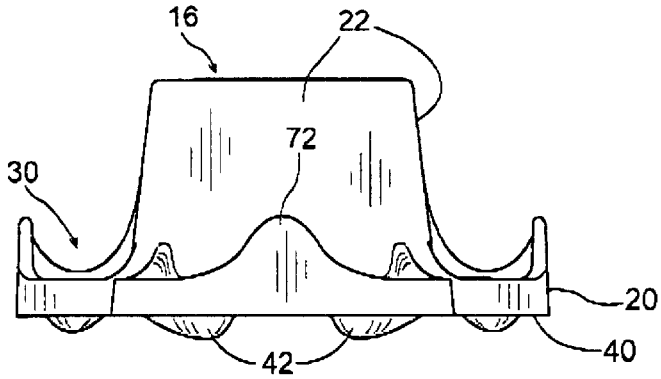
FIG. 2 is an end view of the embodiment of FIG. 1.
Figure 3:
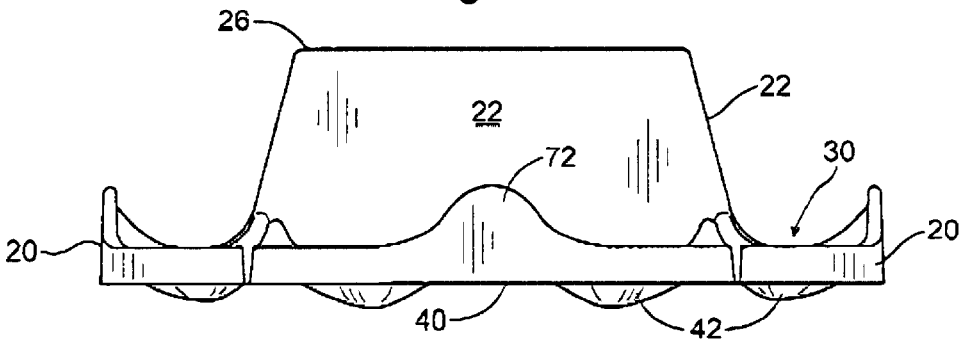
FIG. 3 is a front or a rear view of the embodiment of FIG. 1.

FIGS. 2 and 3 provide an end view and a front or rear view of the embodiment of FIG. 1, in particular. However, in each of FIGS. 2 and 3, it will be seen that the flexible shock absorbing spring transition sections 30 each extend below the bottom edge 40 of the outer container contacting walls 20, as shown at 42. Further discussion of that characteristic of certain embodiments of unitary product cushioning structures in keeping with the present invention, will be discussed in greater detail hereafter.

Figure 4:
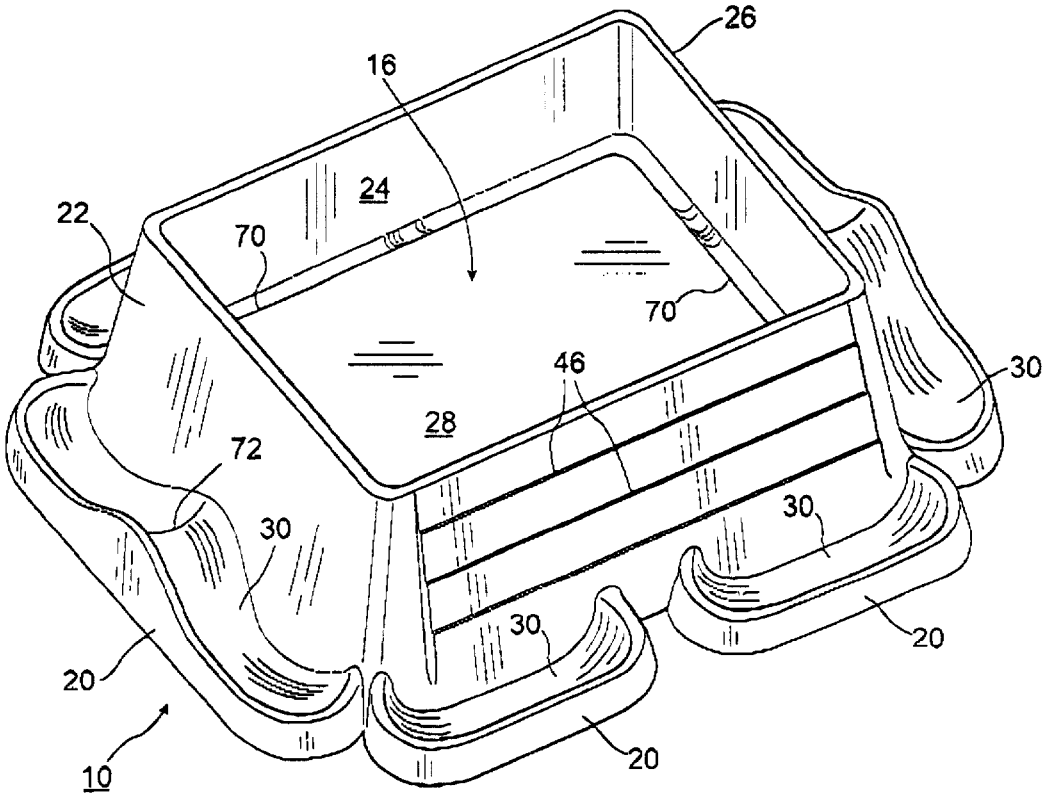
FIG. 4 is a perspective view of a further embodiment of a unitary product cushioning structure in keeping with the present invention.

Referring to FIG. 4, several slight differences will be noted between the embodiment shown in that Figure, and that of FIG. 1. Specifically, it will be noted that there are a pair of discrete flexible shock absorbing spring transition sections 30, each defined by its own respective outer container contacting wall 20. Thus, the outer container contacting wall 20 is discontinuous between each of the flexible shock absorbing spring transition sections 30. The other particular difference is that at least one of the outer product supporting region defining walls 22—the front and rear walls in FIG. 4—is formed so as to have a series of discrete steps 46. As will be described hereafter, the provision of the steps in the outer product supporting region defining wall 22 allows for greater flexibility and, therefore, greater shock absorbing protection for the product, in shock loading conditions.

Figure 5:
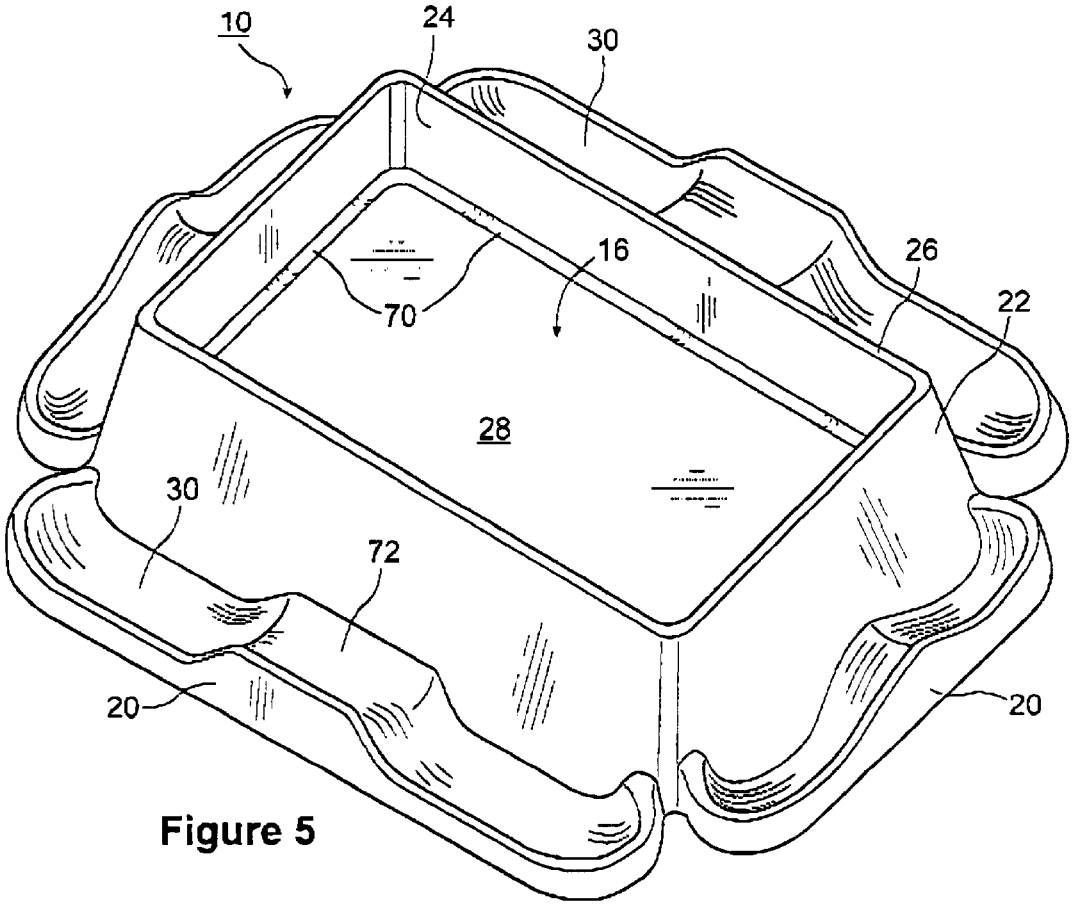
FIG. 5 is shows a further embodiment of a unitary product cushioning structure in keeping with the present invention.
Figure 6:
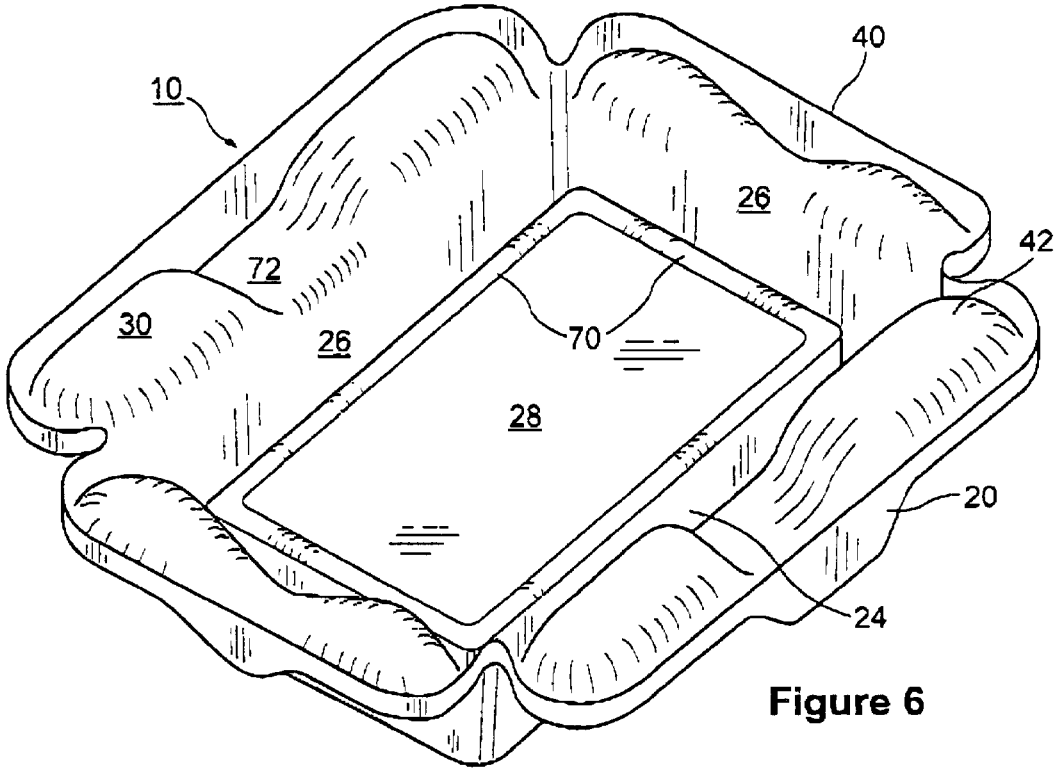
FIG. 6 is a perspective view of the underside of the embodiment of FIG. 5.

Yet another embodiment of end cap, tray, or cover, is shown in FIGS. 5 and 6. The particular characteristic of the embodiment of FIGS. 5 and 6, which differs from the embodiments of any of the previous Figures that have been so far discussed, is that the depth of the product supporting region 16 is less than in the other embodiments. Accordingly, it will be seen in FIGS. 5 and 6 that the length of the inner product contacting walls 24 is shorter than in the embodiments previously discussed. Moreover, it will be clearly understood from examination of FIGS. 5 and 6 that the unitary product cushioning structure may typically be thermoformed from a sheet material, so that the underside of the unitary product cushioning structure takes on an appearance such as that shown in FIG. 6.

Figure 7:
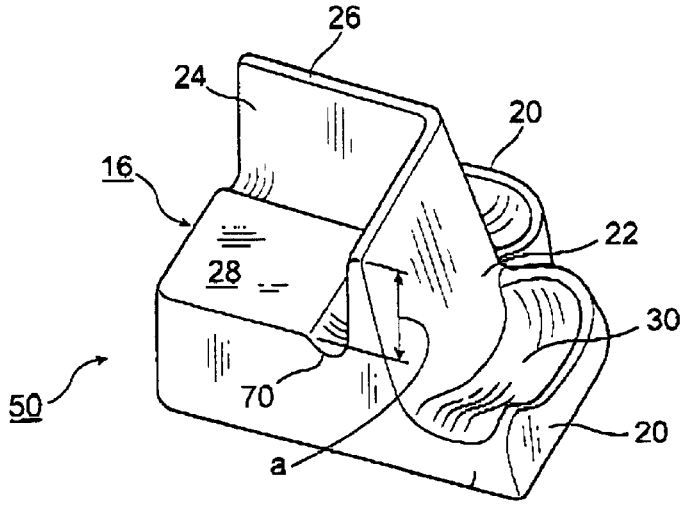
FIG. 7 is a perspective view of a corner piece configuration of the present invention.
Figure 8:
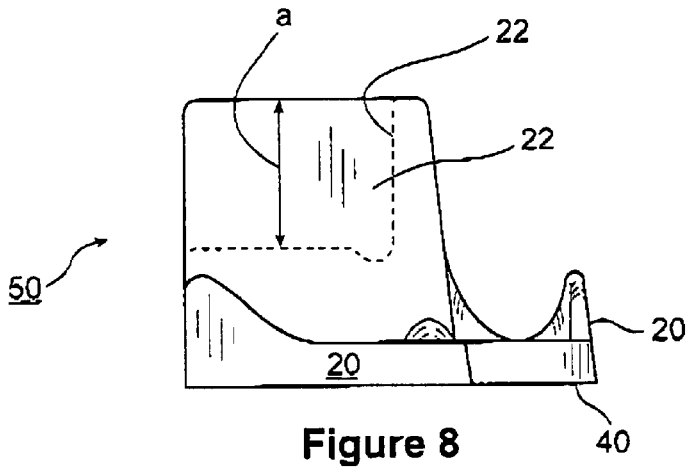
FIG. 8 is a side view of the embodiment of FIG. 7.

Another typical embodiment of unitary product cushioning structure of the present invention is shown in FIGS. 7, 8, and 9. Here, a corner piece 50 is illustrated. In this embodiment, there are but two outer container contacting walls 20, and two outer product supporting region defining walls 22, two inner product contacting walls 24, two upper ridges 26, and one product supporting platform 28. Two flexible shock absorbing spring transition sections 30 are shown. As noted in FIG. 9, a corner piece 50 would be placed at each of eight corners of a typical rectangular product 12, for product cushioning and shock absorbing protection when the product is placed in an outer packaging container, during shock loading conditions.

It will be noted in FIG. 8 that an embodiment of any unitary product cushioning structure of the present invention may be such that the flexible shock absorbing spring transition sections 30 do not extend below the bottom edge 40 of the outer container contacting walls 20, as they do in the manner illustrated previously in FIGS. 2 and 3. This feature will be discussed in greater detail, hereafter.

Figure 11:
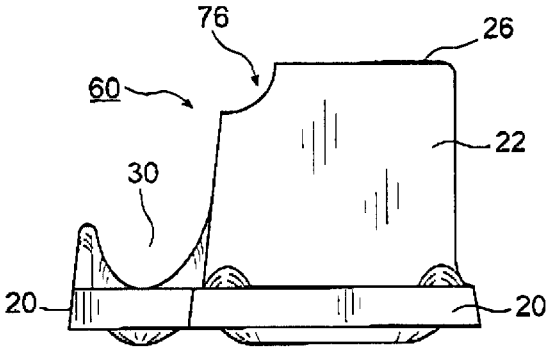
FIG. 11 is a side view of a further embodiment of the embodiment of FIG. 10, showing a further alteration which made be made to any embodiment.
Figure 12:
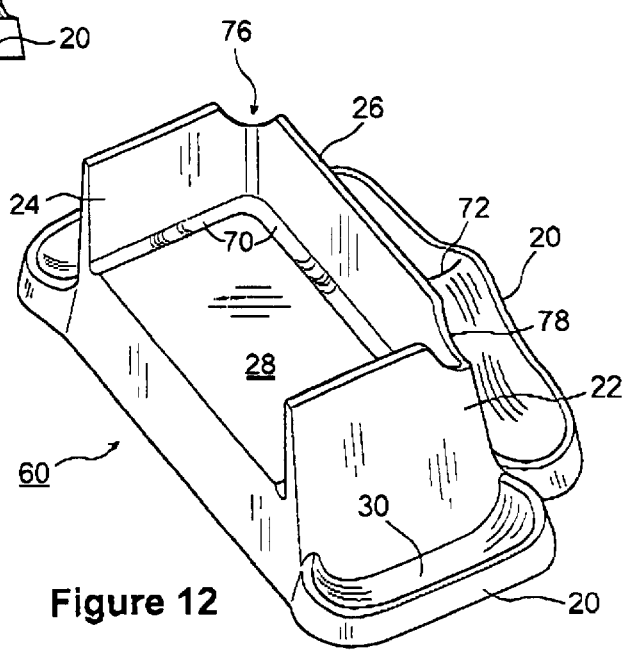
FIG. 12 is a further perspective view of the embodiment of FIG. 11.

Turning now to FIGS. 10, 11, and 12, a general end piece configuration 60 illustrated. Here, there are three outer container contacting walls 20, which are arranged with one opposed pair being substantially parallel to one another, as can be seen in FIGS. 10 and 12. The third outer container contacting wall 20 is disposed between the opposed pair, and is perpendicular to them, as can also be seen in FIGS. 10 and 12.

Examination of FIG. 10 will indicate that, with a rectangular shock sensitive product 12, four end pieces 60 are required to provide shock absorption protection during shock loading conditions.

Figure 13:
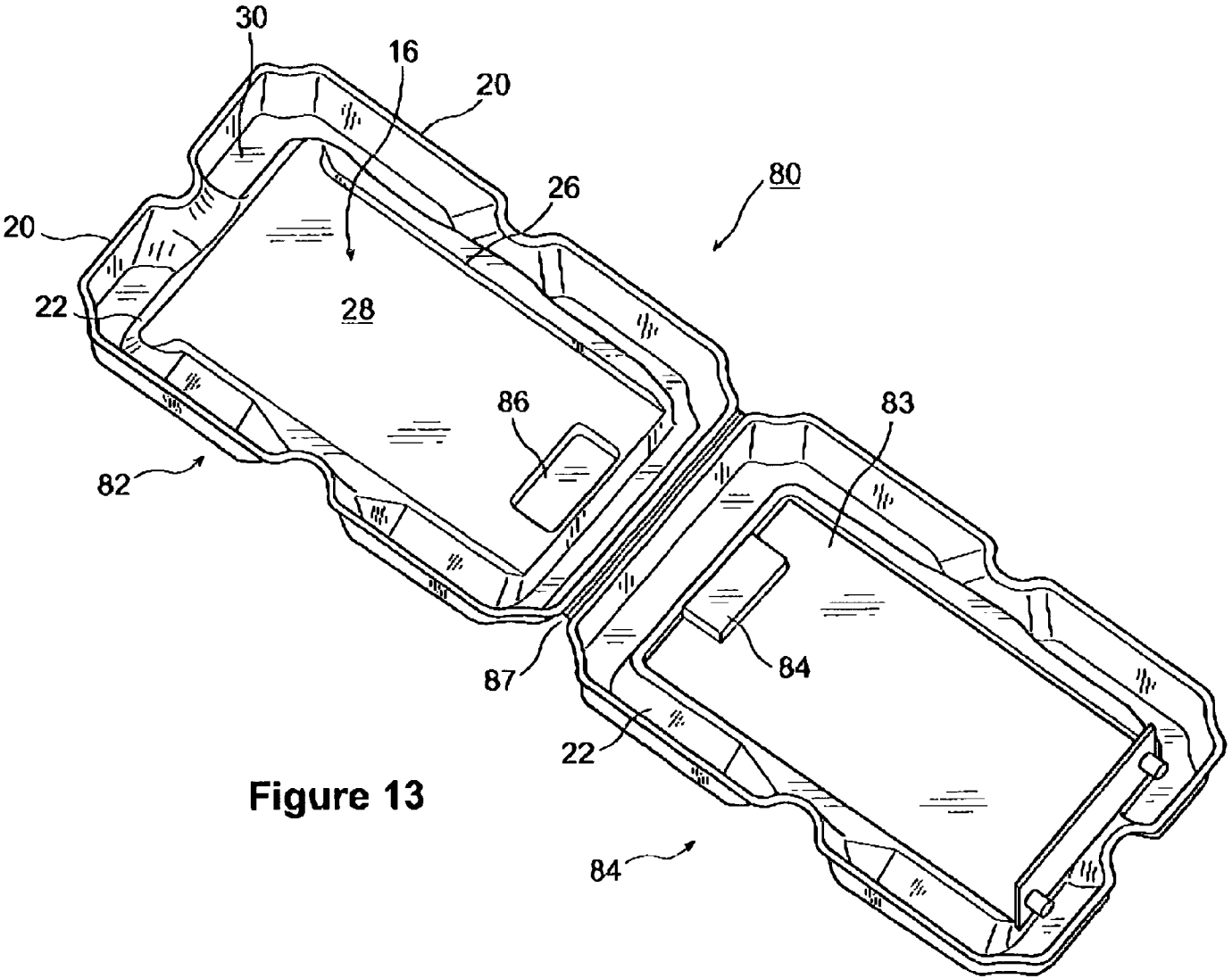
FIG. 13 is a perspective view of the top and bottom of a clamshell configuration of a unitary product supporting structure in keeping with the present invention, with a product in place.

FIG. 13 illustrates yet another embodiment of unitary product cushioning structure in keeping with the present invention. Here, a clamshell structure 80 is provided, comprising an upper portion 82 and a lower portion 84. The upper and lower portions 82 and 84 are joined together by a living hinge 86 formed between them. Thus, the clamshell structure 80 is also a unitary structure.

The basic structural components of any unitary product cushioning structure of the present invention are found in the clamshell structure 80 of FIG. 13. Each of the two halves 82, 84, each of which is substantially rectangular in configuration, has four outer container contacting walls 20; as well as a product supporting region 16 defined by four inner product contacting walls 24, four outer product supporting region defining walls 22, four upper ridges 26, and a product supporting platform 28.

FIG. 13 also shows a shock sensitive product 83 in place in the clamshell unitary product cushioning structure 80. The product 83 may be such as a network card, video card, or the like, of the sort that are typically installed in computers. The product 83 may have connector block 86; if so, a region of the product supporting region 16, in the product supporting platform 28 of the upper portion 82 of the clamshell product cushioning structure 80, may be configured as at 86 so as to conform to and receive the block 86 when the unitary product cushioning clamshell structure 80 is closed.

Figure 14:
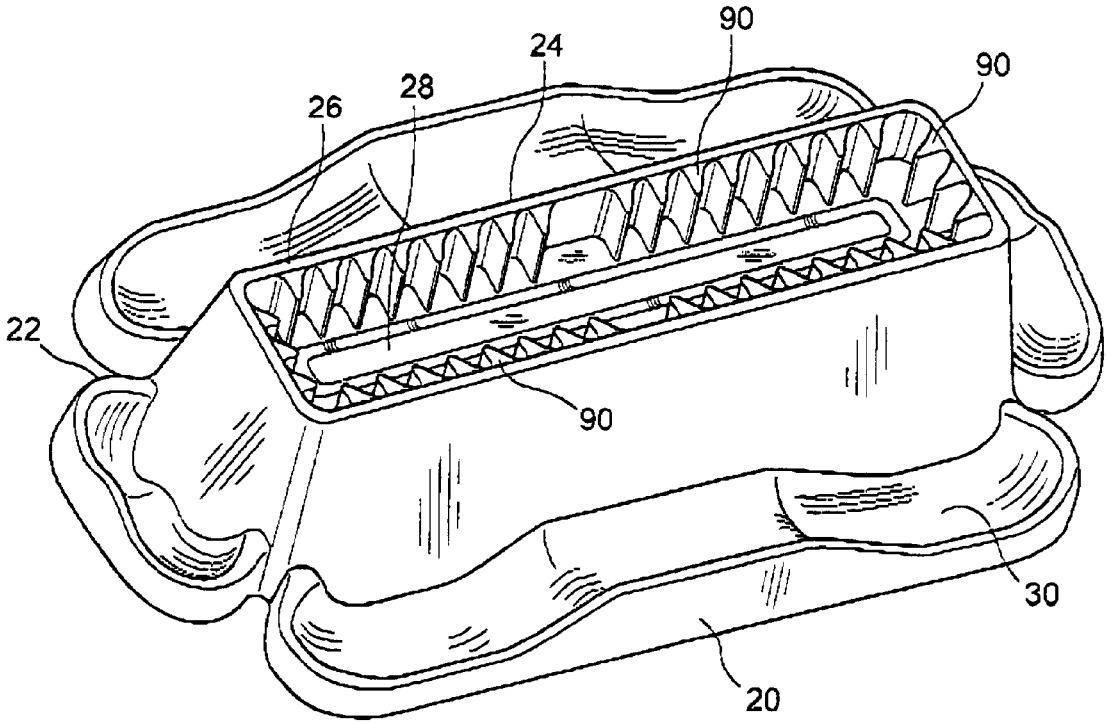
FIG. 14 is a perspective view f a further embodiment of a unitary product cushioning structure in keeping with the present invention.

In the embodiment shown in FIG. 14, the inner product contacting wall 24 may be formed having a convoluted configuration, with a plurality of ridges 90, each of which extends between the product supporting platform 28 and the upper ridge 26. The purpose for the ridges 90 is that, for example, certain related models of a particular shock sensitive product may differ slightly in configuration from one model to another, and by providing a convoluted configuration of the inner product containing walls 24, the various models of the family shock sensitive product can be accommodated. As a specific example, various models of laptop computers might differ slightly in their configuration, depending on the specific options being provided in the respective models, but each has the general configuration and dimensions as any other laptop computer in the same family of models.

Typically, but not always, in any embodiment of unitary product cushioning structure in keeping with the present invention, there may be a flexible joint 70 which is formed between the inner product containing wall 24 and the product supporting platform 28. Typically, the flexible joint 70 is formed at the intersection of each inner product containing wall 24 with the product supporting platform 28. The flexible joint provides additional shock absorbing protection for a product 12 (or 83) when in place in the unitary product cushioning structure according to the present invention.

Some embodiments of unitary product cushioning structures in keeping with the present invention may be formed in such a manner that the flexible shock absorbing spring transition section 30 is formed in at least two portions, each separated one from another by a stiffening rib 72. Such structures are shown, for example, in FIGS. 1, 2 through 6, 10, and 12.

It has been noted above that a purpose of the unitary product cushioning structure of the present invention, in any embodiment, is to provide shock absorbing protection for a shock sensitive product, when placed in an outer packaging container. It has been described that any unitary product cushioning structure in keeping with the present invention is formed of a moldable resilient plastics material.

Typically, unitary product cushioning structures in keeping with the present invention are thermoformed or vacuum formed, but they might in some circumstances be molded using other plastics molding techniques such as injection molding or blow molding or slush molding.

In any event, it is a purpose of the unitary product cushioning structure to provide shock absorption protection in at least two of three mutually perpendicular directions. Those directions are noted, for example, in FIG. 1, as being "X", "Y", and "Z"-axes.

Obviously, any outer container contacting wall 20 will provide contact with an outer packaging container in at least one of the three mutually perpendicular directions—it being considered and assumed that, in all instances, the outer packaging container is essentially rectilinear in configuration.

An edge piece in keeping with the present invention is not specifically illustrated, but it can be determined by an examination of any of FIGS. 1, 4, 5, 6, 10, or 12, for example, that an edge piece would simply comprise a single outer container contacting wall 20, a single outer product supporting region defining wall 22, a single inner product contacting wall 24, a single upper ridge 26, and a product supporting platform 28.

Assume, for example, that such a structure comprises the defined components as discussed immediately above, and is that which is at the lower right side of the embodiment shown in FIG. 1. Obviously, the inner product contacting wall 24 will provide shock absorption support for a product during shock loading conditions in at least one of the three mutually perpendicular directions; if the assumption is made, as discussed immediately above, that would be in the "Y"-axis. Moreover, the simple structure described immediately above also provides shock absorption support in a second direction, due to the presence of the product supporting platform 28. That second direction is, therefore, in the "Z"-axis, and that axis is, by definition, perpendicular to the "Y"-axis.

Shock absorbing protection is provided at least by the presence of the flexible shock absorbing spring transition section 30. Obviously, if the shock load is in the "Y"-axis, the flexible shock absorbing spring transition section 30 will momentarily collapse in a direction towards the outer container contacting wall 20. If the shock load is in the "Z"-axis, then the flexible shock absorbing spring transition section will also flex as a consequence either of the contact between it and the outer packaging container at the surface 42, as shown in FIGS. 2 and 3, for example; or as a consequence of the reaction between the flexible shock absorbing spring transition section 30 and the bottom surface 40 of the outer container contacting wall 20, as shown in FIG. 8.

Accordingly, in its broadest sense, the present invention is adapted to provide shock absorption support for a product during shock loading conditions in at least two of the three mutually perpendicular directions, due to the inner product contacting wall 24 providing shock absorption support in one direction and the product supporting platform 28 providing shock absorption support in a second direction which is perpendicular to the first direction, as a consequence of the presence of the flexible shock absorbing spring transition section 30.

Any of the particular embodiments of corner piece, end piece, end cap, shelf or cover structure, or clamshell structure, as illustrated, will provide shock absorption protection for a shock sensitive product in all three mutually perpendicular directions.

For example, referring to FIG. 9 (as well as FIGS. 7 and 8), it can be easily seen that the presence of the two outer container contacting walls 20, and the associated structure as illustrated and discussed above, is such that shock loading in any of the "X", "Y", or "Z"-axes, will be at least partially absorbed by the unitary product cushioning structure of the present invention.

Likewise, the end piece configuration of FIGS. 10, 11, and 12, is such that shock absorption protection for a shock sensitive product will be provided in all three mutually perpendicular directions. The same holds true, of course, for the end cap, tray or cover, or clamshell configurations of FIGS. 1 through 6, 13, and 14.

In some particular configurations of the present invention, as illustrated in FIG. 8 for example, the outer container contacting wall 20 is downwardly directed and has a bottom edge 40 which provides an outer packaging container contacting surface for the cushioning structure to contact a surface of an outer packaging container. That contact is, of course, in a direction which is substantially aligned with the outer container contacting wall 20, and is perpendicular to at least one of the other mutually perpendicular directions. For example, contact between a surface of an outer packaging container with the outer container contacting wall 40 might be considered in FIG. 8 to be in the "Z"-axis; and that direction is perpendicular to either (or both) of the "X"-axis and "Y"-axis, in respect of which shock absorption support for the shock sensitive product during shock loading conditions is being provided by a respective inner product contacting wall 24.

In other embodiments of the present invention, for example in tray configurations which might be derived from one or other of the portions 82 and 84 of the clamshell configuration 80, the at least one outer container contacting wall 20 is upwardly directed. In that case, the outer packaging container contacting surface is provided by at least a portion of the outer surface of the flexible spring transition section 30, in the manner as illustrated otherwise, for example in FIGS. 2 and 3.

In most configurations, but not all, it is obvious therefore that the outer packaging container contacting surface is, indeed, provided by the portion 42 of the outer surface of the flexible shock absorbing spring transition section 30. As discussed above, contact is thereby provided for the unitary product cushioning structure of the present invention to contact a surface of an outer packaging container in a direction which is perpendicular to any of the product contacting surfaces 24.

In any embodiment of the present invention, but as particularly illustrated in FIGS. 11 and 12, a portion of each of the outer product supporting region defining walls 22, a portion of each of the inner product contacting walls 24, and a portion of each of the upper ridges 26, may be chamfered in the region where the upper ridges 26 intersect. This is shown, for example, in FIGS. 11 and 12, at 76. A web 78 is formed between the respective outer product supporting region defining walls 22 and the inner product contacting walls 24, in the chamfered region 76.

The purpose of the chamfers 76 is to provide additional flexibility for the unitary product cushioning structure of the present invention, particularly when the shock load is directed towards the product supporting platform 28.

Obviously, the product supporting platform 28 may be configured so as to receive a product having a predetermined configuration. An example is, of course, a recess 86 which is formed in the upper portion 82 of the clamshell structure 80, as shown in FIG. 13. However, any particular configuration can be provided; it being recognized that, in such circumstances, the specific unitary product cushioning structure is being manufactured for use with a specified shock sensitive product.

Indeed, most unitary product cushioning structures in keeping with the present invention are particularly designed and molded so as to accommodate a particular shock sensitive product.

Typically, as can be seen in many of the Figures of drawings herein, each outer container contacting wall 20, each outer product supporting region defining wall 22, and each inner product contacting wall 24, may be sloped inwardly and upwardly. This permits similar unitary product cushioning structures in keeping with the present invention to be stackable. This feature is useful when, for example, unitary product structures of the present invention are thermoformed or otherwise molded in a factory in one location and are shipped to a customer for use with that customer's shock sensitive products which are being manufactured in another location. Obviously, stackability reduces shipping costs, resulting in lower prices to the shock sensitive product manufacturer, and ultimately resulting in lower prices to the end consumer of the shock sensitive product.

Particularly when the unitary product cushioning structure of the present invention is thermoformed from a sheet plastics material, the compression strength of the molded unitary structure, and thereby its ability to withstand shock forces, may vary as a function of the thickness of the thermoformable sheet plastic material, from which the molded unitary product cushioning structure has been thermoformed. For example, similar designs of unitary product cushioning structure manufactured from thermoformable sheet plastics material having an initial thickness of 0.080 inches will vary considerably from those manufactured from thermoformable sheet plastics material having an initial thickness of, for example, 0.100 inches, or 0.050 inches. The decision is, of course, determined as a matter of the knowledge of the designer and of the purchaser, of the end purpose to which the unitary product cushioning structure will be put. Obviously, shock sensitive products having the same size but weighing two or three times as much as other shock sensitive products will require unitary product cushioning structures which are thermoformed from thicker sheet plastics materials.

It will be noted from the drawings that each flexible shock absorbing spring transition section is curved, and the direction of that curve is outwardly and away from the respective outer product supporting region defining wall 22, to which it is adjacent. Moreover, the compression strength of the molded unitary structure itself, and thereby its ability to withstand shock forces, may also vary as a function of the width and depth—in other words, the amount of curvature—of each flexible shock absorbing spring transition section 30.

Still other factors affecting the compression strength of the molded unitary product cushioning structures of the present invention are determined by the presence or absence of stiffening ribs 72, chamfers 76, and flexible joints 70.

As noted above, the depth of the product supporting region 16 of any embodiment of unitary product cushioning structure in keeping with the present invention is determined by the height of the inner product contacting wall 24 above the product supporting platform 28. Moreover, it has been noted that the height of the inner product contacting wall 24 may be less—and, in some cases, considerably less—than the length of the outer product supporting region defining wall 22. Typically, the length of the inner product contacting wall 24 is in the range of 10% to 80% of the length of the outer product supporting region defining wall 22; and, in many embodiments of the present invention, the length of the inner product contacting wall is less than 60% of the length of the product supporting region defining wall 22. Such relationship may be understood by reference to FIGS. 7 and 8, where arrow "a" indicates the length or height of the inner product contacting wall 24, and arrow "b" represents the length or height of product supporting region defining wall 22. It will be seen that the relationship between the lengths of arrows "a" and "b" gives rise to the relationship that $a/b<60\%$.

Generally, the elasticity of any plastics material from which the unitary product cushioning structures of the present invention are manufactured, is such that there is no permanent deformation of the unitary product cushioning structures of the present invention, when they have been put to the task of absorbing shock loading so as to protect the shock sensitive product that is in them.

To that end, drop tests on a variety of embodiments of unitary product cushioning structures in keeping with the present invention, having differing sizes and being intended for different purposes have indicated, in each instance, the ability of the unitary product cushioning structures of the present invention to meet all drop test standards. Those standards vary from case to case, depending on the product to be protected, the size and nature of the product cushioning structure, the nature of the outer packaging container, and so on. Generally, a unitary product cushioning structure in keeping with the present invention will reduce the impact forces that are imparted to the shock sensitive product being cushioned, to less than 100 g's. Typically, a level of 50 g's to 60 g's for a drop of about 1 metre is obtained by unitary product cushioning structures in keeping with the present invention.

As noted, the molding techniques which may be employed to manufacture unitary product cushioning structures in keeping with the present invention may include drape molding, vacuum molding, blow molding, slush molding, or injection molding. Typically, thermoforming is the molding process which is employed. Any molding technique, however, which may be employed is well-known to those skilled in the plastics arts, and requires no further discussion herein.

Typical materials from which unitary product cushioning devices of the present invention may be molded include low density polyethylene, high density polyethylene, polyvinylchloride, PET, polystyrene, nylon, polypropylene, and appropriate mixtures and co-polymers thereof. However, it will be understood that the above list of materials is intended to be illustrative but not exhaustive.

There has been described a variety of unitary product cushioning structures, each of which is in keeping with the principals of the present invention. Other modifications and/or alterations may be used in the design and/or manufacture of the apparatus of the present invention, without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially perpendicular is intended to mean perpendicular, nearly perpendicular and/or exhibiting characteristics associated with perpendicularity.

What is claimed is:

1. A unitary product cushioning structure for supporting a shock sensitive product in an outer packaging container, said unitary product cushioning structure being formed of a moldable resilient plastics material;

wherein said unitary product cushioning structure is adapted to provide shock absorption protection for a shock sensitive product during shock loading conditions in at least two of three mutually perpendicular directions;

said unitary product cushioning structure comprising:

at least one outer container contacting wall for providing contact with an outer packaging container in at least a first one of said three mutually perpendicular directions;

a flexible shock absorbing spring transition section formed inwardly of said at least one outer container contacting wall, and having an outer surface; and a product supporting region having at least one outer product supporting region defining wall, at least one inner product contacting wall, at least one upper ridge between said outer product supporting region defining wall and said inner product contacting wall, and a product supporting platform extending inwardly from said inner product contacting wall;

wherein said flexible shock absorbing spring transition section is formed inwardly of said outer container contacting wall and outwardly of said outer product support region defining wall;

wherein said inner product contacting wall is adapted to provide shock absorption support for a product during shock loading conditions in at least one of said three mutually perpendicular directions; and wherein said product supporting platform is adapted to provide shock absorption support for a product during shock loading conditions in a second direction which is perpendicular to at least said first one of said three mutually perpendicular directions.

2. The unitary product cushioning structure of claim 1, wherein said three mutually perpendicular directions are defined by"X", "Y", and "Z"-axes; where the "X"-axis is a side-to-side axis, the "Y"-axis is a front-to-back axis, and the "Z"-axis is a vertical axis.

3. The unitary product cushioning structure of claim 1, wherein there are two outer container contacting walls arranged perpendicular to each other, and said two outer container contacting walls are adapted to contact two walls of said outer packaging container which are perpendicular to one another;

whereby said cushioning structure provides shock absorption protection for a shock sensitive product during shock loading conditions, in three mutually perpendicular directions.

4. The unitary product cushioning structure of claim 3, wherein there are two outer product supporting region defining walls, two inner product contacting walls, and two upper ridges, all defining a corner of said product supporting region;

wherein a portion of each of said outer product supporting region defining walls, of each of said inner product contacting walls, and of each of said upper ridges, in the region where said upper ridges intersect, is chamfered; and wherein a web is formed between the respective outer product supprting region defining walls and inner product contacting walls in said chamfered region.

5. The unitary product cushioning structure of claim 1, wherein there are three outer container contacting walls arranged with one opposed pair thereof being substantially parallel to one another, with a third outer container contacting wall disposed between said opposed pair and being perpendicular thereto;

wherein said three outer container contacting walls are adapted to contact three walls of an outer packaging container, in which two of said three walls are substantially parallel to one another and the third of said three walls is disposed between the first two walls and is perpendicular thereto;

whereby said cushioning structure provides shock absorption protection for a shock sensitive product during shock loading conditions, in three mutually perpendicular directions.

6. The unitary product cushioning structure of claim 5, wherein there are three outer product supporting region defining walls, three inner product contacting walls, and three upper ridges, defining two respective corners of said product supporting region;

wherein a portion of each of said outer product supporting region defining walls, of each of said inner product contacting walls, and of each of said upper ridges, in each region where respective pairs of said upper ridges intersect, is chamfered; and wherein a web is formed in each said chamfered region between the respective outer product supporting region defining walls and inner product contacting walls.

7. The unitary product cushioning structure of claim 1, wherein said at least one outer container contacting wall is upwardly directed; and wherein an outer packaging container contacting surface is provided for said cushioning structure to contact a surface of said outer packaging container in a direction aligned with said at least one outer container contacting wall by a portion of said outer surface of said flexible shock absorbing spring transition section.

8. The unitary product cushioning structure of claim 1, wherein an outer packaging container contacting surface is provided for said cushioning structure to contact a surface of said outer packaging container in a direction perpendicular to said at least a first one of said three mutually perpendicular directions by a portion of the outer surface of said flexible shock absorbing spring transition section.

9. The unitary product cushioning structure of claim 1, further comprising at least one flexible joint between said at least one inner product containing wall and said product supporting platform.

10. The unitary product cushioning structure of claim 1, comprising at least two flexible shock absorbing spring transition sections between said at least one outer container contacting wall and said at least one outer product supporting region defining wall;

whereby said at least one outer container contacting wall is discontinuous between each of said at least two flexible shock absorbing spring transition sections.

11. The unitary product cushioning structure of claim 1, wherein said at least one flexible shock absorbing spring transition section is formed in at least two portions, each separated one from another by a stiffening rib extending between said at least one outer container contacting wall and said at least one outer product supporting region defining wall.

12. The unitary product cushioning structure of claim 1, wherein a portion of each of said outer product supporting region defining walls, of each of said inner product contacting walls, and of each of said upper ridges, in each region where respective pairs of said upper ridges intersect, is chamfered; and wherein a web is formed in each said chamfered region between the respective outer product supporting region defining walls and inner product contacting walls.

13. The unitary product cushioning structure of claim 1, wherein at least one of said product supporting platform and said at least one inner product contacting wall is configured to receive a product having a predetermined configuration.

14. The unitary product cushioning structure of claim 1, wherein each outer container contacting wall, each outer product supporting region defining wall, and each inner product contacting wall, is sloped, so that similar unitary product cushioning structures are stackable.

15. The unitary product cushioning structure of claim 1, wherein said unitary product cushioning structure is thermoformed from sheet plastics material, and wherein the compression strength of the molded unitary structure, and thereby its ability to withstand shock forces, varies as a function of the thickness of the thermoformable sheet plastics material from which the molded unitary product cushioning structure has been thermoformed.

16. The unitary product cushioning structure of claim 1, wherein the compression strength of the molded unitary structure, and thereby the ability thereof to withstand shock forces, varies as a function of the width and depth of each flexible shock absorbing spring transition section formed in said molded unitary product cushioning structure.

17. The unitary product cushioning structure of claim 1, wherein said at least one outer product supporting region defining wall is formed so as to have a series of discrete steps.

18. The unitary product cushioning structure of claim 1, wherein the length of said inner product contacting wall is in the range of 10% to 80% of the length of said outer product supporting region defining wall.

19. The unitary product cushioning structure of claim 1, wherein the length of said inner product contacting wall is less than 60% of the length of said outer product supporting region defining wall.

20. The unitary product cushioning structure of claim 1, wherein said inner product contacting wall has a convoluted configuration with a plurality of ridges extending between said product supporting platform and said upper ridge.

21. The unitary product supporting cushioning structure of claim 1, wherein said flexible shock absorbing spring transition section is curved, with the direction of said curve being outwardly and away from the respective outer product supporting region defining wall.

22. A unitary container product cushioning structure for supporting a shock sensitive product in an outer packaging container, said unitary product cushioning structure being formed of a moldable resilient plastics material;

wherein said unitary product cushioning structure is adapted to provide shock absorption protection for a shock product during shock loading conditions in at least two of three mutually perpendicular directions;

said unitary product cushioning structure comprising:

at least one outer contacting wall for providing contact with an outer packaging container in at least a first one of said three mutually perpendicular directions;

a flexible shock absorbing spring transition section formed inwardly of said at least one outer container contacting wall, and having an outer surface; and a product supporting region having at least one outer product supporting region defining wall, at least one inner product contacting wall, at least one upper ridge between said outer product supporting region defining wall and said inner product contacting wall, and a product supporting platform extending inwardly from said inner product contacting wall;

wherein said inner product contacting wall is adapted to provide shock absorption support for a product during shock loading conditions in at least one of said three mutually perpendicular directions;

wherein said product supporting platform is adapted to provide shock absorption support for a product during shock loading conditions in a second direction which is perpendicular to at least said first one of three mutually perpendicular directions;

wherein there are four outer container contacting walls arranged in two opposed pairs thereof so that said opposed pairs of outer container contacting walls are substantially parallel to one another, and said two pairs of outer container contacting walls are adapted to contact four walls of said outer packaging container arranged in the form of a rectangle;

wherein said unitary product cushioning structure comprises two portions each having two opposed pairs of outer container contacting walls, wherein each portion is associated with a respective at least one flexible shock absorbing spring transition section, and each portion has a product supporting region; and wherein said two portions of said cushioning structure are joined together by a living hinge formed therebetween;

whereby said cushioning structure provides shock absorption protection for a shock sensitive product during shock loading conditions, in three mutually perpendicular directions.

23. A unitary product cushioning structure for supporting a shock sensitive product in an outer packaging container, said unitary product cushioning structure being formed of a moldable resilient plastics material;

wherein said unitary product cushioning structure is adapted to provide shock absorption protection for a shock sensitive product during shock loading conditions in at least two of three mutually perpendicular directions;

said unitary product cushioning structure comprising:

at least one outer container contacting wall for providing contact with an outer packaging container in at least a first one of said three mutually perpendicular directions;

wherein said at least one outer container contacting wall is downwardly directed, and has a bottom edge which provides an outer packaging container contacting surface for said cushioning structure to contact a surface of said outer packaging container in a direction aligned with said at least one outer container contacting wall and perpendicular to at least a first one of said three mutually perpendicular directions a flexible shock absorbing spring transition section formed inwardly of said at least one outer container contacting wall, and having an outer surface; and a product supporting region having at least one outer product supporting region defining wall, at least one inner product contacting wall, at least one upper ridge between said outer product supporting region defining wall and said inner product contacting wall, and a product supporting platform extending inwardly from said inner product contacting wall; and wherein said inner product contacting wall is adapted to provide shock absorption support for a product during shock loading conditions in at least one of said three mutually perpendicular directions;

whereby said product supporting platform is adapted to provide shock absorption support for a product during shock loading conditions in at least two of said three mutually perpendicular directions.

* * * * *